US009649528B2

(12) United States Patent
Hou

(10) Patent No.: US 9,649,528 B2
(45) **Date of Patent: *May 16, 2017**

(54) TREADBOARD OF A TREADMILL AND A TREADMILL

(71) Applicant: XIAMEN AOLRO TECHNOLOGY CO., LTD., Xiamen, Fujian (CN)

(72) Inventor: Yanwei Hou, Xiamen (CN)

(73) Assignee: XIAMEN AOLRO TECHNOLOGY CO., LTD., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/244,643

(22) Filed: Aug. 23, 2016

(65) Prior Publication Data

US 2016/0361589 A1 Dec. 15, 2016

Related U.S. Application Data

(62) Division of application No. 14/561,880, filed on Dec. 5, 2014, now Pat. No. 9,452,314.

(30) Foreign Application Priority Data

| | | |
|---|---|---|
| Aug. 7, 2014 | (CN) | 2014 1 0386164 |
| Aug. 7, 2014 | (CN) | 2014 2 0443715 U |
| Aug. 15, 2014 | (CN) | 2014 2 0463387 U |

(51) Int. Cl.

| | |
|---|---|
| ***A63B 22/00*** | (2006.01) |
| ***A63B 22/02*** | (2006.01) |
| ***A63B 21/02*** | (2006.01) |

(52) U.S. Cl.
CPC ..... *A63B 22/0207* (2015.10); *A63B 21/026* (2013.01); *A63B 22/02* (2013.01);
(Continued)

(58) Field of Classification Search
USPC ..... 482/1–148
See application file for complete search history.

(56) References Cited

U.S. PATENT DOCUMENTS

| | | | |
|---|---|---|---|
| 2,252,431 | A | 8/1941 | Klammt |
| 2,919,824 | A | 1/1960 | Roth |

(Continued)

FOREIGN PATENT DOCUMENTS

| | | | |
|---|---|---|---|
| CN | 2584232 | Y | 11/2003 |
| CN | 202892783 | U | 4/2013 |

(Continued)

*Primary Examiner* — Stephen Crow
(74) *Attorney, Agent, or Firm* — Rabin & Berdo, P.C.

(57) ABSTRACT

A treadboard and a treadmill includes two first elastic strips of same structure arranged abreast with the lengths disposed along the moving direction of the belt of the treadmill and a plurality of solid support strips; the first elastic strips are arc structural, the center of the arc structure is higher than two ends of the arc structure; either end of each first elastic strip is once formed with buffer portion that is flexible along the length direction, so that the buffer portions buffer the arc structure of the first elastic strip after fixedly connected to the base of the treadmill; the solid support strips is of straight strip structure respectively connected vertically between the two first elastic strips, two ends of each solid support strip are respectively connected to the corresponding upper sides of the two first elastic strips.

5 Claims, 7 Drawing Sheets

(52) U.S. Cl.
CPC ..... *A63B 22/0214* (2015.10); *A63B 22/0235* (2013.01); *A63B 22/0285* (2013.01)

(56) References Cited

U.S. PATENT DOCUMENTS

| | | | | |
|---|---|---|---|---|
| 3,024,891 | A | 3/1962 | Sawrie | |
| 3,075,764 | A | 1/1963 | DeLorean | |
| 3,403,880 | A | 10/1968 | Rude | |
| 4,361,115 | A | 11/1982 | Pike | |
| 4,938,473 | A | 7/1990 | Lee et al. | |
| 4,974,831 | A | 12/1990 | Dunham | |
| 5,382,207 | A | 1/1995 | Skowronski et al. | |
| 5,385,520 | A | 1/1995 | Lepine et al. | |
| 5,441,468 | A | 8/1995 | Deckers et al. | |
| 6,042,514 | A | 3/2000 | Abelbeck | |
| 6,663,540 | B1 * | 12/2003 | Huang | A63B 22/02 482/54 |
| 8,118,888 | B2 | 2/2012 | Molter et al. | |
| 8,308,619 | B1 | 11/2012 | Astilean | |
| 8,343,016 | B1 | 1/2013 | Astilean | |
| 8,690,738 | B1 | 4/2014 | Astilian | |
| 8,920,347 | B2 | 12/2014 | Bayerlein et al. | |
| 8,986,169 | B2 | 3/2015 | Bayerlein et al. | |
| 9,005,085 | B2 | 4/2015 | Astilean | |
| 9,039,580 | B1 | 5/2015 | Bayerlein et al. | |
| 9,114,276 | B2 | 8/2015 | Bayerlein et al. | |
| 9,452,314 | B2 * | 9/2016 | Hou | A63B 22/02 |
| 2006/0182576 | A1 | 8/2006 | Foster | |
| 2007/0155592 | A1 | 7/2007 | Hoag | |
| 2012/0010053 | A1 | 1/2012 | Bayerlein et al. | |
| 2015/0087484 | A1 | 3/2015 | Bayerlein et al. | |
| 2015/0210348 | A1 | 7/2015 | Astilean | |

FOREIGN PATENT DOCUMENTS

| | | | |
|---|---|---|---|
| CN | 203469310 | U | 3/2014 |
| CN | 203694512 | U | 7/2014 |
| CN | 204106941 | U | 1/2015 |
| CN | 204106942 | U | 1/2015 |

* cited by examiner

TREADBOARD OF A TREADMILL AND A TREADMILL

CROSS-REFERENCE TO RELATED APPLICATION

This application is a divisional of co-pending application Ser. No. 14/561,880, filed Dec. 5, 2014, and the right of priority of parent application is and was claimed under 35 USC §119 of Chinese Application No. 201410386164.2, filed Aug. 7, 2014, Chinese Application No. 201420443715.X, filed Aug. 7, 2014, and Chinese Application No. 201420463387.X, filed Aug. 15, 2014, the entire disclosure of which is incorporated herein by reference.

FILED OF THE INVENTION

The present invention relates to a sports and gymnastic equipment, especially to a treadboard of a treadmill and a treadmill.

BACKGROUND OF THE INVENTION

Traditional treadboard of treadmill is usually applied with a flat board, the belt of the treadmill moves on the flat board, as the flat board is rigid, the feet of the running sportsman hard contacts on the treadboard, which hurts the knee and the ankle joints of the sportsman. Existing treadboard of the treadmill is usually applied with springs or elastic rubber body below the treadboard to buffer the flat board, however, the treadboard is a single configuration that the sportsman still hard contacts instantly when stamping on the treadboard. A new treadboard is disclosed in the Chinese patent database with publishing number CN203469310U, the flat board is replaced by an arc structural board, so that the entire board is transformed when a sportsman is stamping on the treadboard, however, in this case, the sportsman still hard contacts on the treadboard instantly when stamping on the treadboard, above problem still happens; besides, when assembling, as one end of the arc structure has to be movable so as to move to the another movable end, thus making it complicated and inconvenient to assemble.

SUMMARY OF THE INVENTION

To solve the technical problems of the existing technology, the present invention is provided with a treadboard of a treadmill and a treadmill, in which the treadboard is partially transformed when a sportsman is stamping on, so that the sportsman softly contacts on the treadboard instantly when stamping on the treadboard, like running on the grass, thus improving the comfort and exorcising the damage to the knee and ankle joints during exercise.

The technical proposal of the present invention to solve above problems is that:

A treadboard of a treadmill, comprising:

two first elastic strips of same structure arranged abreast with the lengths disposed along the moving direction of the belt of the treadmill; the first elastic strips are arc structural, the center of the arc structure is higher than two ends of the arc structure; either end of each first elastic strip is once formed with buffer portion that is flexible along the length direction, so that the buffer portions buffer the arc structure of the first elastic strip after fixedly connected to the base of the treadmill;

a plurality of solid support strips of straight strip structure respectively connected vertically between the two first elastic strips, two ends of each solid support strip are respectively connected to the corresponding upper sides of the two first elastic strips.

In another preferred embodiment, two ends of the first elastic strips are respectively disposed with a bending portion bending inwardly along the length and formed with a bending section to fix to the base of the treadmill; the inwardly bending portion and the bending section form the buffer portion.

In another preferred embodiment, two ends of the first elastic strips are respectively disposed with a bending portion bending outwardly along the length and formed with a bending section to fix to the base of the treadmill; the inwardly bending portion and the bending section form the buffer portion.

In another preferred embodiment, the first elastic strip is of equal thickness.

In another preferred embodiment, it further comprises two second elastic strips of arc structure that respectively contacted on the bottom surface of the corresponding first elastic strip between the buffer portions in the two ends of the corresponding first elastic strip.

In another preferred embodiment, the first elastic strip is of unequal thickness that the thickness is gradually decreased from the center to two ends.

In another preferred embodiment, the top and bottom surfaces of the solid support strips are arc structural.

In another preferred embodiment, it further comprises a soft wear-resistant board that covered on the centers of the plurality of the solid support strips.

In another preferred embodiment, it further comprises a plurality of cushions with same number with the solid support strips that the cushions are respectively connected to the center of the top bottom of the solid support strips and the soft wear-resistant board is covered on the cushions.

The present invention is further provided with a treadmill, which comprises a main frame, a belt mechanism and above said treadboard, the main frame comprising armrests and a base, the treadboard and the belt mechanism are respectively assembled to the base so that the belt of the belt mechanism is coupled to the treadboard; two ends of the two elastic strips of the treadboard are respectively fixedly connected to the base front and rear.

Compared to existing technology, the technical proposal of the present invention has advantages as below:

1. as two ends of the first elastic strips are respectively once forming with a buffer portion flexible along the length, so that the buffer portions buffer the arc structure of the first elastic strip after fixedly connected to the base of the treadmill, it solves the problem of existing entire arc board that one end thereof can not be fixed. The buffer portions and the arc structure are cooperated to form two buffer effects, the first effect works by the arc structure of the first elastic strips themselves, with the arc structure, the center of the arc structure is higher than the two ends, it forms a downwardly elastic buffering when the protruding portion of the arc structure is stamped by a running sportsman; the second effect works by the buffer portions at the two ends of the first elastic strip, as the two ends of the first elastic strips has buffer portions flexible along the length, after the bending sections of the buffer portions are fixedly connected to the base of the treadmill, when the sportsman is stamping on the treadboard, the protruding portions at the center of the first elastic strips buffer downwardly to form force outward the two ends, the present invention is applied with bending portions of the first elastic strips 1 to buffer this force.

2. the present invention is applied with a plurality of solid support strips of straight strip structure respectively connected vertically between the two first elastic strips. the present invention is configured with the solid support strips the solid support strips and the two first elastic strips coupled to form the board, which replaces the traditional entire board structure, when the sportsman stamps on some solid support strips of the treadboard of the present invention, the first elastic strips in the right position buffer downwardly, while the rest part of the first elastic strips do not buffer, so that it partially transforms, the first elastic trips have wavy buffer effect, the sportsman will soft stamp on the treadboard, like running on the grass, thus improving the exercise comfort and exorcising the damage to the knee and ankle joints during exercise.

3. the present invention is applied with two second elastic strips respectively contacted on the bottom surface of the corresponding first elastic strips between the buffer portions at the two ends of the corresponding first elastic strips, or the first elastic strip has unequal thickness, the thickness of the first elastic strip 1 is gradually decreased from the center to the two ends, so that the thickness of the buffer portion at the two ends of the first elastic strip is thinner so as to work with elastic, it also enhances the strength of other part of the first elastic strip, thus ensuring an effective support to the sportsman stamping on the treadboard.

4. the present invention is applied with a plurality of soft cushions with same number with the solid support strips that the cushions are respectively connected to the top bottom of the solid support strips and a soft wear-resistant board covered on the cushions, so that the cushions work with a buffering effect, making it more soft and comfort when a sportsman stamps on the treadboard to exercise; the soft wear-resistant board protects the cushions and the solid support strips, thus lengthening the service life of the product.

DETAILED DESCRIPTION OF THE EMBODIMENTS

Figure 1:
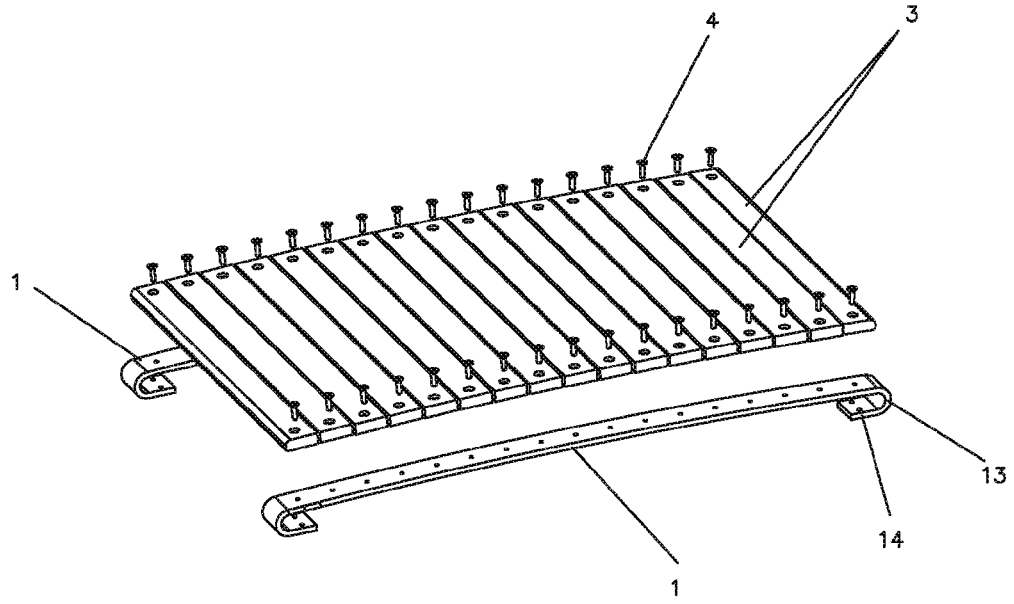
FIG. 1 illustrates an exploded and schematic diagram of a first embodiment of a treadboard of the present invention.
Figure 2:
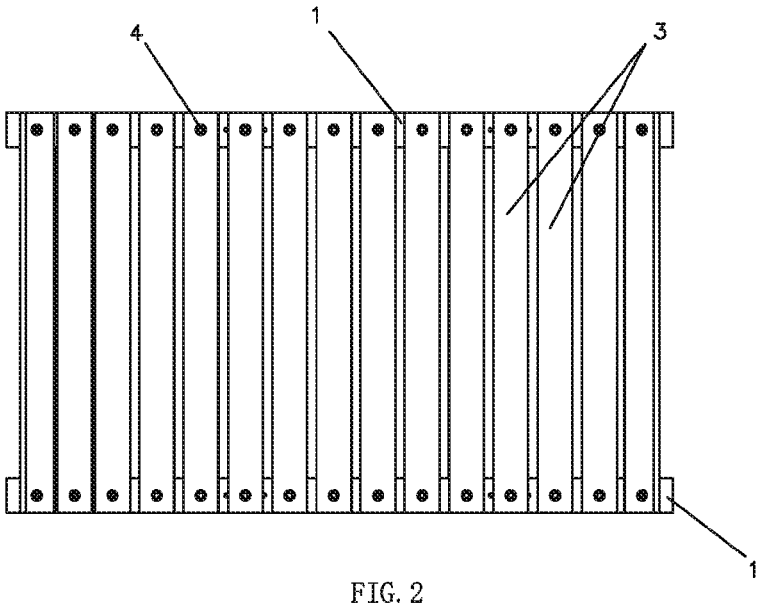
FIG. 2 illustrates a top view of the first embodiment of the treadboard of the present invention.
Figure 3:
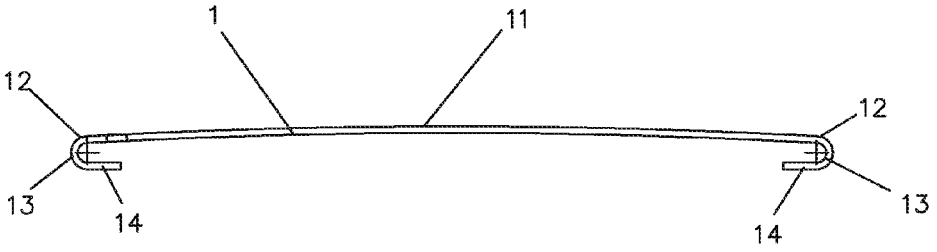
FIG. 3 illustrates a front view of the first elastic strip of the first embodiment of the treadboard of the present invention.
Figure 4:
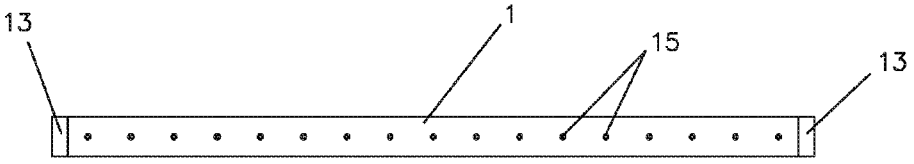
FIG. 4 illustrates a top view of the first elastic strip of the first embodiment of the treadboard of the present invention.
Figure 5:
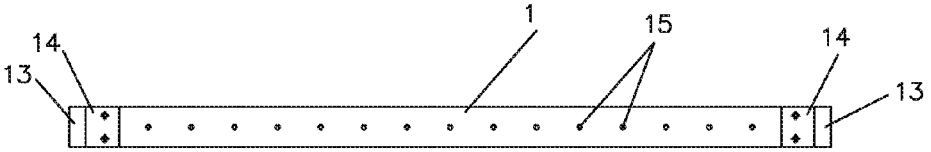
FIG. 5 illustrates a bottom view of the first elastic strip of the first embodiment of the treadboard of the present invention.

The present invention will be further described with the drawings and the embodiments.

The First Embodiment

As figured in FIGS. 1-5, a treadboard of a treadmill of the present invention comprises:

Two first elastic strips 1 of same structure arranged abreast, the length of the first elastic strip 1 is arranged along the moving direction of the belt of the treadmill; the first elastic strip 1 is arc structural that the center is higher than two ends, that is to say, the center 11 of the first elastic strip 1 is higher than two ends 12 of the first elastic strip 1, two ends of the first elastic strips 1 are respectively once forming with a buffer portion flexible along the length, so that the buffer portions buffer the arc structure of the first elastic strip after fixedly connected to the base of the treadmill;

A plurality of solid support strips 3 of straight strip structure respectively connected vertically between the two first elastic strips 1, two ends of each solid support strip 3 are respectively connected to the corresponding upper sides of the two first elastic strips 1.

In this embodiment, two ends of the first elastic strips 1 are respectively disposed with a bending portion 13 bending inwardly along the length and formed with a bending section 14 to fix to the base of the treadmill; the inwardly bending portion 13 and the bending section 14 form the buffer portion.

The bending portion 13 is circular arc structural. In other cases, it can be arc structural.

The bending section 14 is arranged horizontally.

In this embodiment, the first elastic strip 1 is of equal thickness.

In this embodiment, the first elastic strip 1 is an arc strip made of elastic steel. In other cases, the first elastic strip 1 can be made of other elastic material like carbon fiber board or rubber board.

The first elastic strip 1 is disposed with a plurality of screw holes 15, two ends of each solid support strip 3 are respectively fixedly connected to the upper sides of the two first elastic strips 1 by screws 4.

The solid support strips 3 are evenly vertically connected between the two first elastic strips 1 respectively.

In this embodiment, the solid support strips 3 are straight strip structures made of wooden material. In other cases, the solid support strips can be straight strip structures made of steel plate, plastic or rubber material, etc. To enhance the strength, it should be embedded with metal piece in the plastic or rubber straight strip structure.

The top surface and the bottom surface of the solid support strips 3 are respectively arc structural. The arc structure of the top surface and the bottom surface of the solid support strips 3 are coupled to the arc structure of the first elastic strips 1 in the position the solid support strip fixedly connected to the first elastic strips.

In the treadboard of a treadmill of the present invention, when assembling, the solid support strips 3 are respectively fixedly connected between the two first elastic strips 1, thus forming a board with arc structure, then the bending sections 14 at the two ends of the two first elastic strips 1 are respectively fixedly connected to the base of the treadmill.

The treadboard of the present invention with this kind of structure can bring some elastic and buffering effects, the first effect works by the arc structure of the first elastic strips 1 themselves, with the arc structure, the center of the arc structure is higher than the two ends, it forms a downwardly elastic buffering when the protruding portion of the arc structure is stamped by a running sportsman; the second effect works by the buffer portions at the two ends of the first elastic strip 1, as the two ends of the first elastic strips has buffer portions flexible along the length, after the bending sections of the buffer portions are fixedly connected to the base of the treadmill, when the sportsman is stamping on the treadboard, the protruding portions at the center of the first elastic strips 1 buffer downwardly to form force outward the two ends, the present invention is applied with bending portions 13 of the first elastic strips 1 to buffer this force; the third effect works by the solid support strips 3, the solid support strips 3 and the two first elastic strips 1 are coupled to form the board, which replaces the traditional entire board structure, when the sportsman stamps on some solid support strips of the treadboard of the present invention, the first elastic strips 1 in the right position buffer downwardly, while the rest part of the first elastic strips do not buffer, so that it partially transforms, the first elastic trips have wavy buffer effect, the sportsman will soft stamp on the treadboard, like running on the grass, thus improving the exercise comfort and exorcising the damage to the knee and ankle joints during exercise.

The Second Embodiment

Figure 6:
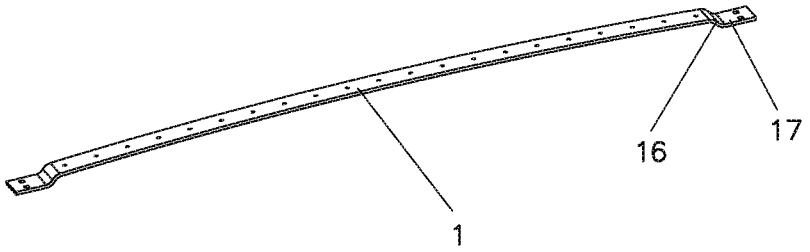
FIG. 6 illustrates a schematic diagram of the first elastic strip of a second embodiment of a treadboard of the present invention.

As figured in FIG. 6, the treadboard of a treadmill in this embodiment has difference from the first embodiment that two ends of the first elastic strips 1 are respectively bended outwardly to be a bending portion 16 and formed with a bending section 17 to fix to the base of the treadmill, the bending sections 17 are horizontally arranged, so as to fix to the base of the treadmill conveniently, the bending portion 16 is bended downwardly first and then outwardly.

The Third Embodiment

Figure 7:
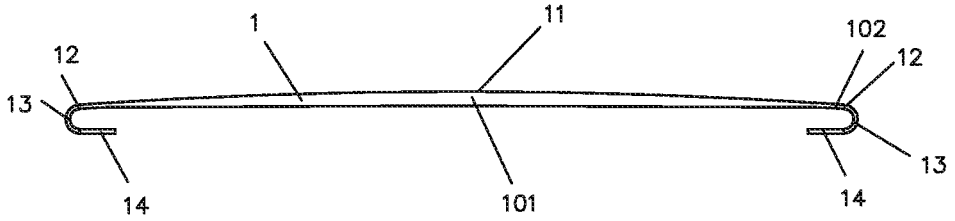
FIG. 7 illustrates a schematic diagram of the first elastic strip of a third embodiment of a treadboard of the present invention.

As figured in FIG. 7, the treadboard of a treadmill in this embodiment has difference from the first embodiment that the first elastic strip 1 has unequal thickness, that is to say, the thickness of the first elastic strip 1 is gradually decreased from the center to the two ends, so that the thickness of the center 101 is larger than the thickness of the two ends 102.

As the first elastic strip 1 has unequal thickness, and the thickness of the first elastic strip 1 is gradually decreased from the center to the two ends, so that the thickness of the buffer portion at the two ends of the first elastic strip 1 is thinner so as to work with elastic, it also enhances the strength of other part of the first elastic strip, thus ensuring an effective support to the sportsman stamping on the treadboard.

The Fourth Embodiment

Figure 8:
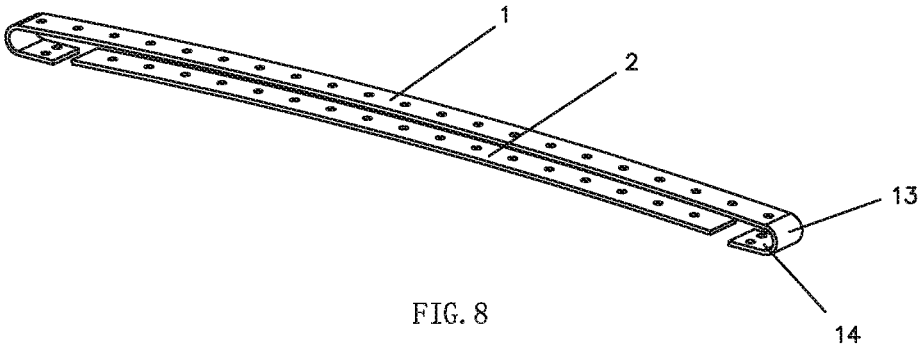
FIG. 8 illustrates a schematic diagram of the first elastic strip of a fourth embodiment of a treadboard of the present invention.

As figured in FIG. 8, the treadboard of a treadmill in this embodiment has difference from the first embodiment that it further comprises two second elastic strips 2 of arc structure that respectively contacted on the bottom surface of the corresponding first elastic strips 1 between the buffer portions at the two ends of the first elastic strips.

The present invention is applied with two second elastic strips 2 respectively contacted on the bottom surface of the corresponding first elastic strips between the buffer portions at the two ends of the corresponding first elastic strips, so that the thickness of the buffer portion at the two ends of the first elastic strip 1 is thinner so as to work with elastic, it also enhances the strength of other part of the first elastic strip, thus ensuring an effective support to the sportsman stamping on the treadboard.

The Fifth Embodiment

Figure 9:
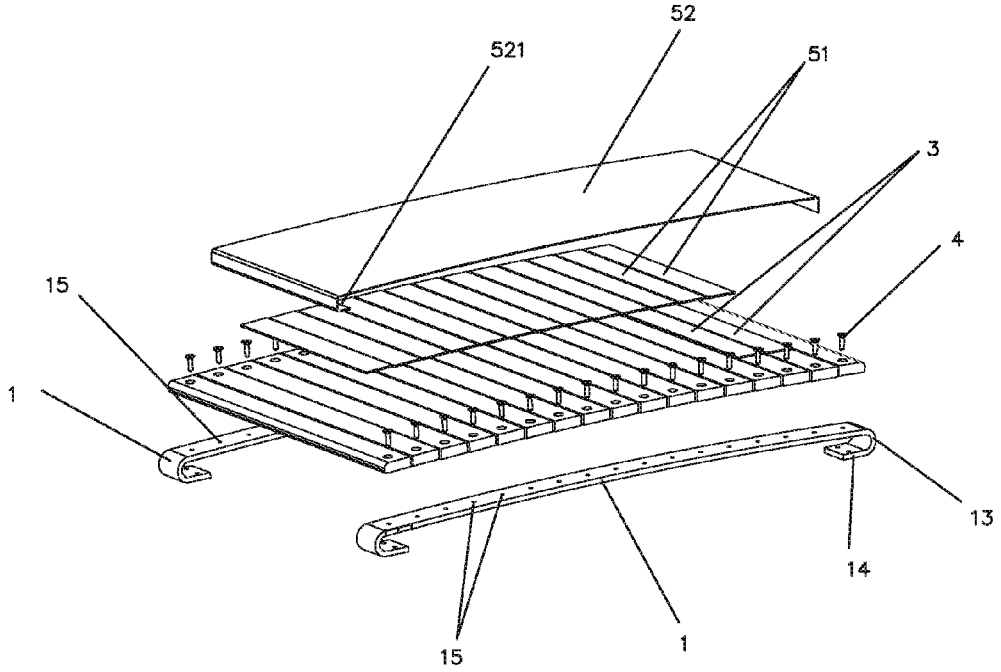
FIG. 9 illustrates an exploded and schematic diagram of a fifth embodiment of a treadboard of the present invention.
Figure 10:
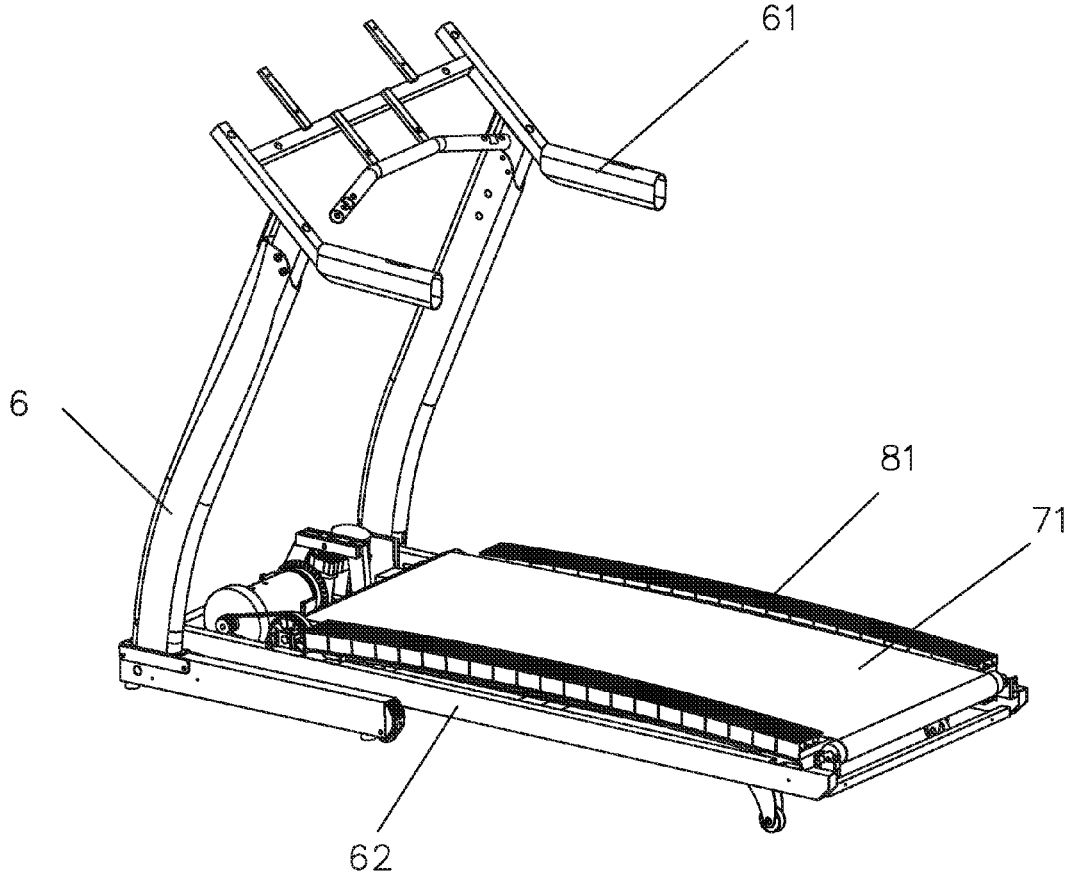
FIG. 10 illustrates an exploded and schematic diagram of a sixth embodiment of a treadmill of the present invention.
Figure 11:
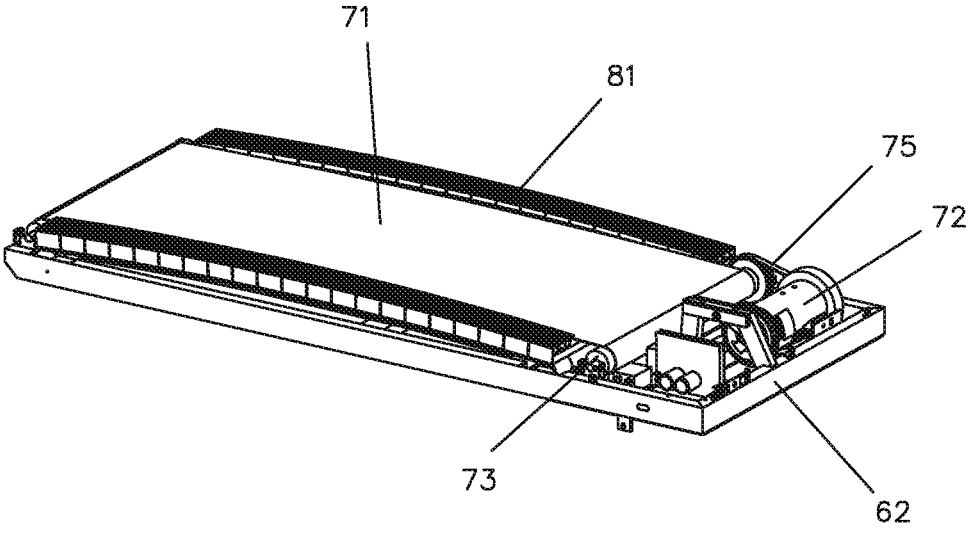
FIG. 11 illustrates a schematic diagram of the treadboard, the belt mechanism and the base in their cooperation in the sixth embodiment of the treadmill of the present invention.
Figure 12:
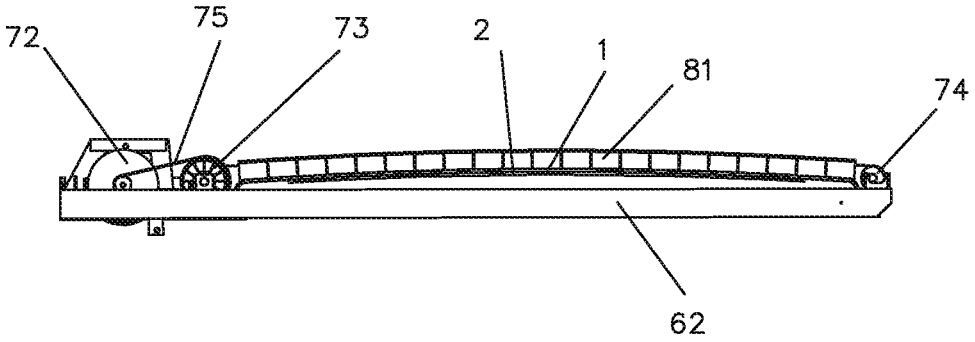
FIG. 12 illustrates a front view of the treadboard, the belt mechanism and the base in their cooperation in the sixth embodiment of the treadmill of the present invention.
Figure 13:
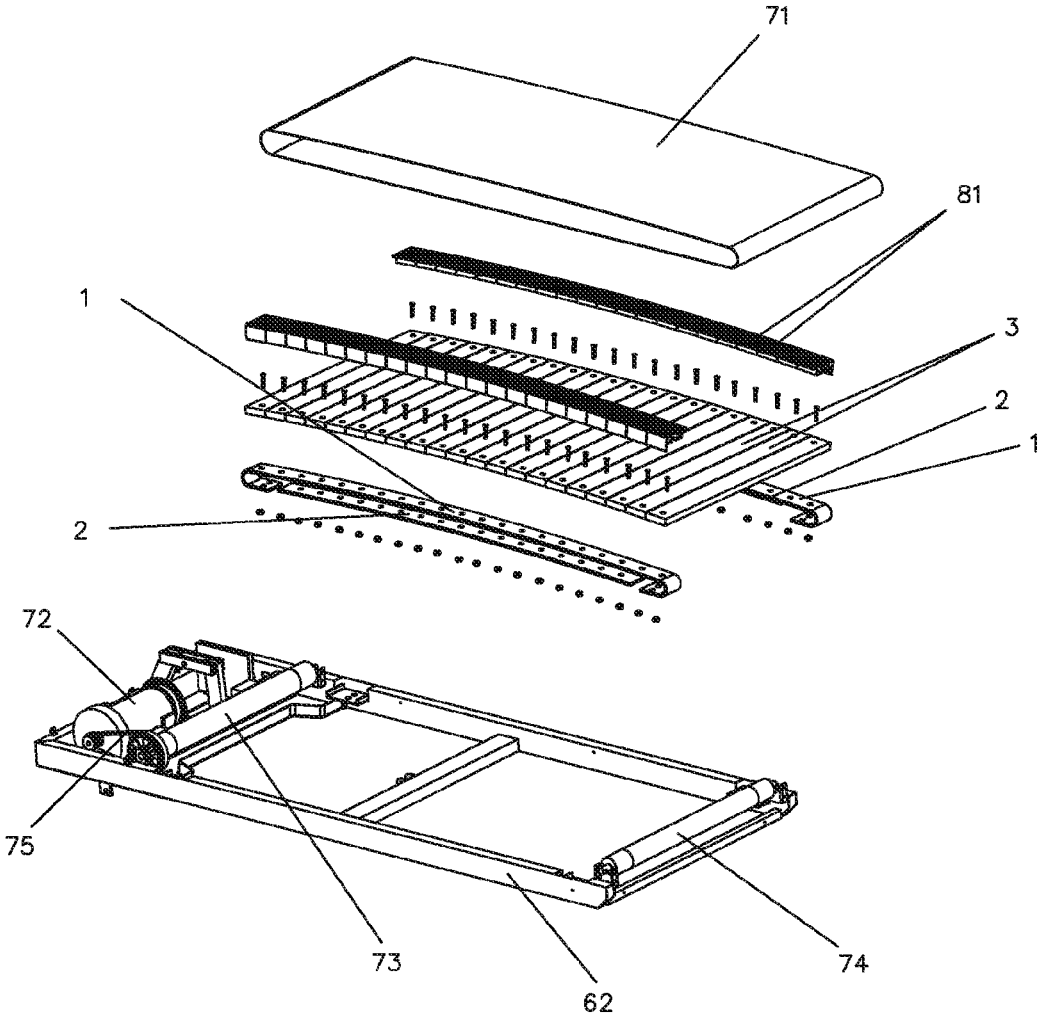
FIG. 13 illustrates an exploded and schematic diagram of the treadboard, the belt mechanism and the base in their cooperation in the sixth embodiment of the treadmill of the present invention.

As figured in FIG. 9, a treadboard of a treadmill in this embodiment has difference from the first embodiment that it further comprises:

A plurality of soft cushions 51 with same number with the solid support strips that the cushions are respectively connected to the top bottom of the solid support strips 3;

A soft wear-resistant board 52 covered on the cushions 51. one end of the soft wear-resistant board 52 is disposed with a lock portion 521 to lock to the components composed from the cushions 51 and the solid support strips 3, this end is disposed facing to the moving direction of the belt of the treadmill, the other end of the soft wear-resistant board 52 is free.

The length of the cushion 51 is smaller than the length of the solid support strip 3, the width of the soft wear-resistant board 52 is larger than the width of the cushion 51.

The present invention is applied with a plurality of soft cushions 51 with same number with the solid support strips that the cushions are respectively connected to the top bottom of the solid support strips 3 and a soft wear-resistant board 52 covered on the cushions 51, so that the cushions 51 work with a buffering effect, making it more soft and comfort when a sportsman stamps on the treadboard to exercise; the soft wear-resistant board 52 protects the cushions 51 and the solid support strips 3, thus lengthening the service life of the product.

The Sixth Embodiment

As figured in FIG. 10 to FIG. 13, a treadmill of the present invention comprises a main frame 5, a belt mechanism and a treadboard, the main frame 6 comprises armrests 61 and a base 62, the treadboard and the belt mechanism are respectively assembled to the base 62, the belt mechanism comprises a belt 71, a motor 72, a front roller 73, a rear roller 74 and a driving portion 75, the belt 71 is assembled between the front roller 73 and the rear roller 74, the front roller 73 is linked to the motor 72 via the driving portion 75, the belt 71 of the belt mechanism is coupled to the treadboard; the treadboard comprises two same structural first elastic strips 1 and a plurality of solid support strips 3, two first elastic strips 1 are arranged abreast, the length of the first elastic strips 1 is configured along the moving direction of the belt of the treadmill; the first elastic strips 1 are arc structural, so that the center of the arc structure is higher than two ends, that is to say, the center 11 of the first elastic strip 1 is higher than two ends 12 of the first elastic strip 1, two ends of the first elastic strips 1 are respectively once forming with a buffer portion flexible along the length, so that the buffer portions buffer the arc structure of the first elastic strip after fixedly connected to the base of the treadmill; the solid support strips 3 of straight strip structure respectively connected vertically between the two first elastic strips 1, two ends of each solid support strip 3 are respectively connected to the corresponding upper sides of the two first elastic strips 1. In this embodiment, two ends of the first elastic strip 1 are respectively disposed with a bending portion 13 bending inwardly along the length direction, and forming with a bending section 14 to fix to the base of the treadmill; the inwardly bending portion 13 and the bending section 14 form the buffer portion, that is to say, the first elastic strips 1 are applied with the structure of the first embodiment. In this embodiment, it further comprises two second elastic strips 2 of arc structure respectively contacted on the bottom surface of corresponding first elastic strip 1 between the buffer portions at the two ends of the corresponding first elastic strip 1. In this embodiment, it further comprises a plurality of treadles 81 with twice as much as the solid support strips 3, the treadles 81 are respectively fixedly connected to the two ends of the solid support strips 3. The bending sections 14 of the first elastic strips 1 are fixed to the base 62.

When assembling, two ends of the solid support strips 3 are respectively connected to the two first elastic strips 1 to form a board plate of arc structure, then the bending sections 14 of the two first elastic strips 1 are respectively fixed to the base 62 front and rear, the belt 71 is wrapped on the treadboard.

As can be seen from above, the first elastic strips of the treadboard can be applied with kinds of structures, for example, the bending portion can be bended inwardly or outwardly to form a buffer portion flexible along the length; the thickness of the first elastic strip is equal or unequal, the second elastic strips can be configured below the first elastic strips to enhance the strength of the first elastic strips. And the layer structure of the treadboard can be varied, for example, it can be a single layer composite of the solid support strips, or it can be further configured with a soft wear-resistant board, in other cases, a cushion layer can be applied between the solid support strips and the soft wear-resistant board.

INDUSTRIAL APPLICABILITY

The present invention is configured two same structural first elastic strips to be arc structures, and a buffer portion is once forming at either end of the first elastic strips to fix to the base of the treadmill thus to buffer the arc structure of the first elastic strips, the buffer portion is composed of a bending portion at either end of the first elastic strip 1 bending inwardly or outwardly along the length and a bending section formed from the bending portion, it is easy to realize in the industry. In additional, the present invention is configured with a plurality of solid support strips to fix to the first elastic strips to replace traditional entire board structure, so that the solid support strips are configured to realize a partial transforming of the treadboard, the sportsman stamps on the treadboard softly, like running on the grass, thus improving the exercise comfort and exorcising the damage to the knee and ankle joints during exercise, the solid support strips are easy to manufactured in the industry.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A treadboard of a treadmill, comprising:

two first elastic strips of a same shape arranged abreast having lengths disposed along a moving direction of a belt of the treadmill, the two first elastic strips having an arc structure, a center of the arc structure being higher than two ends of the arc structure, at least one end of each of the two first elastic strips having a buffer portion that is flexible along a length direction, the buffer configured to buffer the arc structure of the respective first elastic strip based on the respective first elastic strip being fixedly connected to a base of the treadmill; and a plurality of straight-shaped solid support strips respectively connected between the two first elastic strips, two ends of each solid support strip being respectively connected to corresponding upper sides of the two first elastic strips.

2. The treadboard according to claim 1, wherein the buffer portion includes a bending portion bent inwardly along the length direction of the respective first elastic strip, and a bending section configured to be fixedly connected to the base of the treadmill.

3. The treadboard according to claim 1, wherein the first elastic strip is of uniform thickness.

4. The treadboard according to claim 1, further comprising a soft wear-resistant board covering centers of the plurality of solid support strips.

5. The treadboard according to claim 4, further comprising a plurality of cushions equal in number to the solid support strips, wherein the plurality of cushions are respectively connected to the top surface of the solid support strips along a center of the top surface of the solid support strips, and the soft wear-resistant board covers the cushions.

* * * * *